US006066074A

United States Patent [19]

Marcinkiewicz

[11] Patent Number: 6,066,074

[45] Date of Patent: May 23, 2000

[54] EXERCISE APPARATUS AND METHOD

[75] Inventor: Joseph Gerald Marcinkiewicz, Leeds, United Kingdom

[73] Assignee: Switched Reluctance Drives Limited, Harrogate, United Kingdom

[21] Appl. No.: 09/114,863

[22] Filed: Jul. 13, 1998

[30] Foreign Application Priority Data

Jul. 11, 1997 [GB] United Kingdom ..... 9714696

[51] Int. Cl.[7] ..... A63B 21/00

[52] U.S. Cl. ..... 482/4; 482/54; 482/903

[58] Field of Search ..... 482/1–9, 51, 54, 482/57, 64, 65, 71, 72, 900–903

[56] References Cited

U.S. PATENT DOCUMENTS 5,569,121 10/1996 Sellier ..... 482/5
5,583,403 12/1996 Anjanappa et al. ..... 482/91

FOREIGN PATENT DOCUMENTS 2 709 067 2/1995 France .
WO 95/08369 3/1995 WIPO .

*Primary Examiner*—Glenn E. Richmon
*Attorney, Agent, or Firm*—Patterson & Keough, P.A.

[57] ABSTRACT

An exercise machine includes a switched reluctance motor which drives a moveable surface upon which a user can exercise. A controller which is responsive to sudden load changes on the moveable surface controls the torque developed by the motor substantially to maintain a desired motor speed output without the need for a flywheel. In a first embodiment, the controller uses a feedback signal from a rotor position encoder and a motor speed indicator to control the motor output using a proportional-plus-integral signal processor. In a second embodiment, a composite state observer is used to provide estimates of the rotor position, motor speed and load disturbance states from which real time closed loop control of the motor speed with load disturbances on the moveable surface is effected. Corresponding methods also are disclosed.

19 Claims, 17 Drawing Sheets time time time time

EXERCISE APPARATUS AND METHOD

CROSS-REFERENCE TO RELATED APPLICATION

The subject matter of this application is related to the subject matter of British Patent Application No. GB 9714696.3, priority to which is claimed under 35 USC 119 and which is incorporated herein by reference in its entirety.

BACKGROUND OF THE INVENTION

1. Field of the Invention

This invention relates to exercise apparatus. The invention is particularly applicable to exercise apparatus designed to simulate the motion of a travelling body.

2. Description of Related Art

Exercise apparatus is known which allows the user to simulate an exercise in the form of human-powered transport, or simply walking or running. Among these are treadmills, rowing machines and exercise cycles. They have been developed to allow the user to perform an exercise in a confined space that would otherwise require a large area. Other forms of exercise apparatus provide a force to exercise against. In this, they are static (producing a torque to exercise against) as opposed to dynamic (producing a motion).

One of the basic aspects of most types of apparatus of this kind is the simulation of the momentum of either the human body or the transport being simulated. This is commonly achieved by using a flywheel linked to the apparatus, counter to the inertia of which the user exerts a force in performing the exercise. As an example of this, the exercise treadmill provides a so-called 'rolling road' in the form of a conveyor belt powered by an electric motor. Typical motors are induction motors, brushed permanent magnet motors and brushless dc motors.

The 'runner' moves relative to the belt but actually remains substantially stationary. To take the weight of the runner, the flexible belt travels across a support such that the runner's leading foot hits the belt immediately above the support and is carried backwardly. The impact of the foot on the belt pinches the belt between the foot and the support creating a sudden load on the motor. The speed of the travelling belt is maintained by a flywheel operably mounted in relation to the motor so that little or no change in the speed of the belt is perceived by the runner as a result of the foot hitting the belt. Similarly, there are occasions in the running cycle when both feet are out of contact with the belt and it is equally important that the speed of the belt is not substantially increased before the next foot to land makes contact with the belt.

From this it will be appreciated that using a treadmill exercise apparatus involves the relatively sudden imposition and relief of loads on the motor as the feet perform the running action. Known drive systems which are cost-effective in such apparatus are unable to maintain the belt at a sufficiently constant speed. In order to reduce the speed fluctuation to an acceptable level, the flywheel is used to increase the inertia of the rotating components and damp out short-term fluctuations.

The mechanical dynamics of the system are dominated by the inertia of the flywheel and the friction in the belt/roller system. The system therefore has very slow and well-damped dynamics, and any electrical or mechanical disturbances will be substantially suppressed. Any device used for torque or speed-control feedback may accordingly be of relatively low quality, in order to maintain overall costs.

It is well known that flywheels, by their nature, are relatively heavy items and often of a size which makes them awkward to integrate into a housing for the other, significantly smaller, components that will be associated with powering a piece of exercise apparatus. The presence of the flywheel in an exercise apparatus of the type described may significantly increase the size of the unit overall.

If the flywheel is removed from a prior art exercise machine in an effort to save cost and weight, the source of mechanical inertia is essentially removed. Thus, the control system will demand rapidly changing amounts of torque from the motor as the runner's foot lands on the moveable surface. The motor typically employed in such a machine has a relatively low bandwidth. It is therefore unable to react quickly enough to the change in torque demand and the speed of the moveable surface accordingly varies to an unacceptable degree. Attempts to improve the response time by increasing the bandwidth of the controller tend to be counterproductive as the controller cost rises dramatically and the overall response time of the system is limited by the motor's bandwidth.

As a practical matter, the standard of flywheel that is cost effective to use in exercise apparatus may well be inadequately balanced. The motor typically runs at 5000 rpm, which can mean that an inadequately balanced rotating flywheel gives rise to objectionable vibration while the apparatus is in use.

A further disadvantage of the use of a flywheel in exercise apparatus is that it can take a considerable time for the exercise machine to come to rest when the power is removed from the drive motor. This can have undesirable consequences in the event of the user stumbling and operating an emergency stop.

SUMMARY OF THE INVENTION

It is an object of the present invention to provide exercise apparatus in which the above and other problems associated with prior art apparatus are avoided.

A switched reluctance motor has a relatively wide bandwidth. In effect, it acts as a 'torque source'—that is, the motor delivers the torque demanded from it within a time scale much less than the frequency of the fluctuations in the load. By coupling the switched reluctance motor with a wide bandwidth controller, for example, a system is provided that has a bandwidth wide enough to permit real-time control of the variation in motor speed output to within a suitably small amount in e.g. an exercise apparatus, without the need for a flywheel. A state observer makes the flywheel redundant. While state observer theory has been used in the past to control plant, it is not known to the inventors that it has been used to avoid the use of a component in a plant. Up to now, exercise apparatus has had to use a heavy mass to provide inertia. This is now obviated by embodiments of the present invention. Removal of the flywheel reduces the weight of the apparatus and the tendency toward vibration that can be a consequence of an out-of-balance flywheel.

The state observer technique of control has been used in the past to control systems. However, the inventors have recognized that the state observer technique can be used to replace the flywheel as opposed simply to controlling the existing system. The advantageous combination of the switched reluctance motor and the state observer control technique has given rise to exercise apparatus and method embodiments that are lighter and quicker to respond to changing demands.

Thus, when the runner's foot hits the belt of a treadmill, for example, the small initial reduction in speed is detected and the control system reacts to bring the speed back to the demanded level.

In treadmills and other dynamic exercise machines, the output of the machine is speed as this is linked directly to the speed the runner wishes to maintain. In a static machine, the output is torque or force against which the user exerts a torque or force. The machine parameters are rooted in rotor position as this is fundamental to operation of a switched reluctance machine. However, while the rotor position measured may be used to derive (e.g.) speed or another parameter, speed or torque could be measured directly. Another parameter that could be measured in order to derive a measure of the variable of concern is stator excitation current or, possibly, voltage developed. The control regimes for switched reluctance machines are well known to the person of ordinary skill in the art and will not be further described. The operation and control of switched reluctance motors is described in 'The Characteristics, Design and Applications of Switched Reluctance Motors and Drives' by Dr. J. M. Stephenson and Dr. R. J. Blake, PCIM'93, Nurnberg, Germany, June 1993, which is incorporated herein by reference.

One advantage of a switched reluctance motor in this context is that it is significantly cheaper than other motors which have correspondingly wide bandwidths.

According to one embodiment of the present invention there is provided exercise apparatus comprising: a switched reluctance machine; a load operably connected with the machine; user exercise means arranged to vary the overall load on the machine when in use; and a controller for controlling an output of the machine, the controller including means for receiving a demand input, means for producing a control signal for adjusting the machine output in accordance with the demand input, state observer means arranged to receive a signal indicative of at least one machine parameter to produce a machine disturbance compensation signal, and means for applying the compensation signal to the controller signal to assist the convergence of the machine output with the demand input.

According to one embodiment, the machine comprises a rotor and a stator. The machine output is preferably selected from the group comprising machine rotor position, speed and torque. Preferably, the at least one machine parameter is selected from the group comprising machine rotor position, speed, torque, current and voltage, the state observer means being responsive to the signal indicative of the at least one machine parameter.

In one particular form the apparatus further comprises means for producing a rotor position signal and means for producing a machine speed signal, the state observer means being arranged to produce the disturbance compensation signal in response to the rotor position signal and the machine speed signal. The motor speed signal may be derived from the rotor position signal. The disturbance compensation signal may be produced from an estimate of the overall load change based on the signal indicative of the at least one machine parameter.

When the apparatus is a treadmill, the load on the machine includes a roller and the exercise means comprises a belt engaged by the roller, providing a rolling road surface on which to exercise by running. The exercise apparatus may also be constituted by a rowing machine or an exercise cycle, for example.

The rotor position indication may be by means of a rotor position transducer or a binary encoder. Alternatively, a sensorless rotor position indicator may be used. The motor speed signal means may produce a motor speed signal by differentiating the signal produced by the rotor position indicator means with respect to time. Alternatively, a high bandwidth tachometer could be used.

Other apparatus and method embodiments according to the invention will become apparent from the following description.

BRIEF DESCRIPTION OF THE DRAWINGS

The present invention can be put into practice in various ways, some of which will now be described by way of example with reference to the accompanying drawings in which.

DETAILED DESCRIPTION OF PREFERRED EMBODIMENTS

Figure 1:
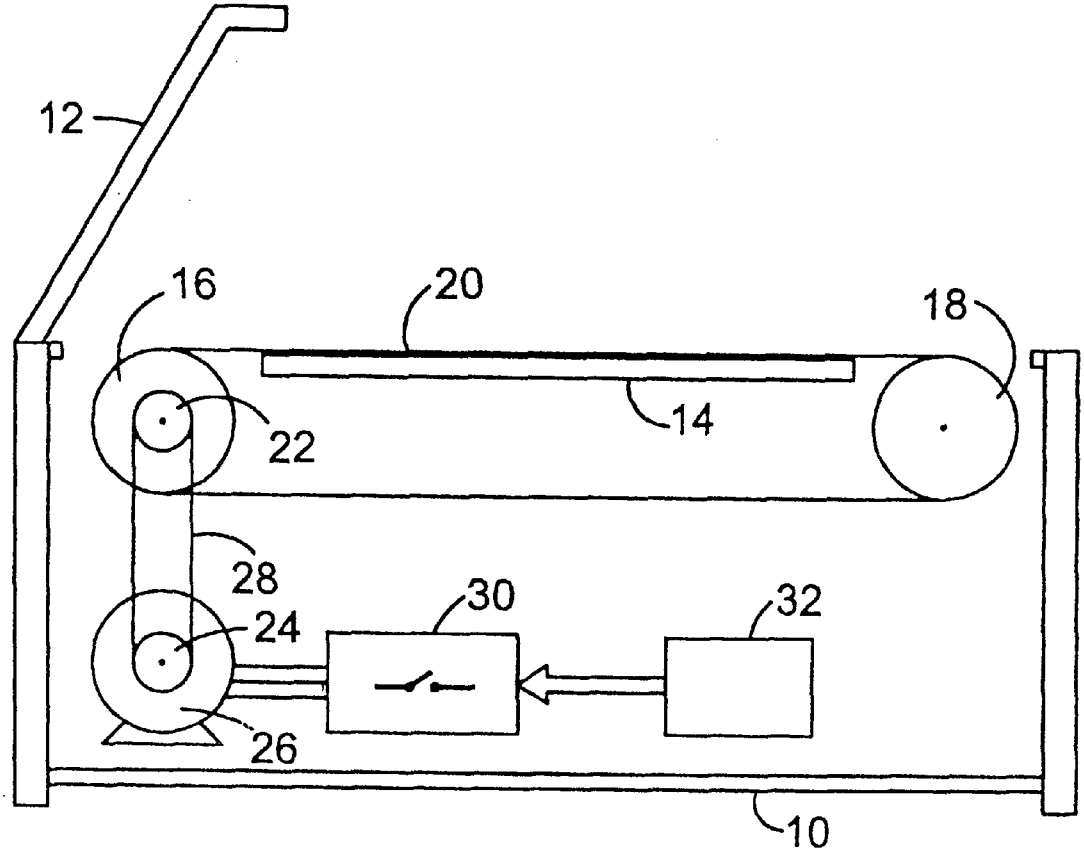
FIG. 1 is a schematic diagram of a treadmill according to an embodiment of the invention.

Referring to FIG. 1 of the drawings, an exercise treadmill according to an embodiment of the invention comprises a frame 10 to which a support rail 12 is attached. A running platform 14 having a low friction upper surface defining a substantially horizontal plane is supported by the frame. Front and rear rollers 16/18 in the form of elongate cylindrical members are attached to the frame at either end of the platform 14 by means of bearings such that the upper circumferential extent of each roller is generally aligned with the plane of the upper surface of the platform. A conveyor in the form of a flexible belt 20 is looped around the rollers 16/18 passing across the upper surface of the platform 14. Means for tensioning the belt, adjusting the inclination of the belt, etc., have been omitted for clarity.

The front roller 16 is a driven roller in this embodiment and the rear roller 18 is an idler. A first pulley wheel 22 is mounted to rotate with the drive roller 16. A switched reluctance motor 26 has a second pulley 24 which is drivingly engaged with the first pulley wheel 22 by a drive belt 28.

The belt 20 passing over the upper surface of the platform 14 and between the rollers 16/18 forms a rolling road supported by the platform 14. The rolling road moves across the upper surface of the platform 14 from the front to the rear, driven by the switched reluctance motor 26.

The motor is controlled by actuation of a switching circuit 30 in conventional manner in the field of switched reluctance motors. This is described in the paper 'The Characteristics, Design and Applications of Switched Reluctance Motors and Drives' by Stephenson and Blake, referred to above. The switch timing is effected by a controller 32 programmed to carry out a switching strategy that is designed to control the torque output of the motor with changes in the load.

At this point, a consideration of the control requirements is appropriate. In the case of a treadmill, the rolling road of the belt is run on by the user at the linear speed of movement of the belt so that the user is effectively at a standstill. The running speed can be varied by varying the speed of the belt. In the act of running, the user introduces each foot to the belt at a leading position. Without the presence of the platform 14, the belt would clearly have a spongy feel to it which would not be an accurate simulation of a satisfactory running surface. Therefore, the platform 14 supports the belt while each foot is in contact with it, but particularly as the lead foot hits the belt. At the moment of impact of the foot on the belt, the belt is pinched between the foot and the platform so that there is a sudden increase in the resistance to movement of the belt which must be countered by the motor. The overall load on the motor thus varies by the sudden application of the foot pinching the belt against the platform.

Figure 2:
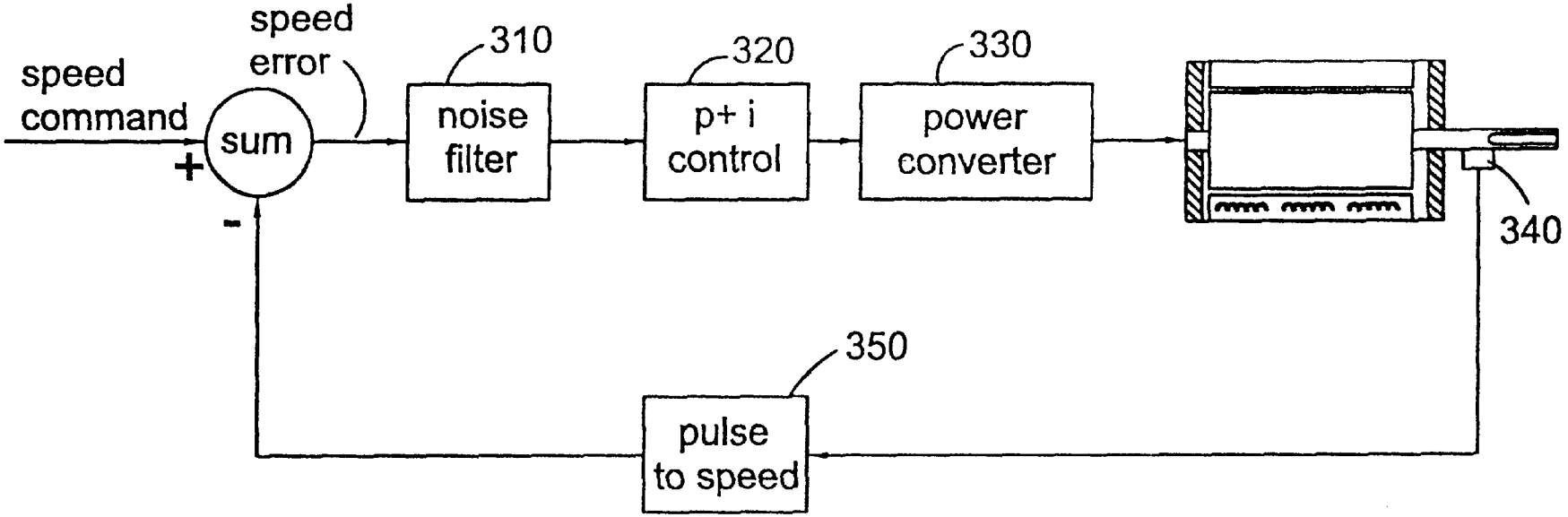
FIG. 2 is a schematic diagram of a first embodiment of a controller for use in the treadmill of FIG. 1.

FIG. 2 shows a controller embodiment for a treadmill, the controller having a high bandwidth which removes the need for a flywheel. The user-defined speed command is applied to a summing junction and then the error is applied to a low pass noise filter 310 and next to a switched reluctance controller 320 of the proportional-plus-integral (P+I) type. The torque demand signal which is the output of the controller 320 is used as the input to a conventional switched reluctance motor power converter 330 which includes a rectifier circuit for converting ac mains into a dc voltage. The dc voltage is switched across the phase windings of a switched reluctance motor with a typical output power of around 2 kW. A rotor position encoder 340 is mounted in relation to the motor shaft to produce a feedback signal that is converted into a speed signal in a pulse-to-speed converter 350. This signal is in turn used as an input to the system to control the output of the motor according to the torque requirements. An encoder would typically have a position resolution one order of magnitude more accurate than a known rotor position transducer for a switched reluctance motor.

Figure 3:
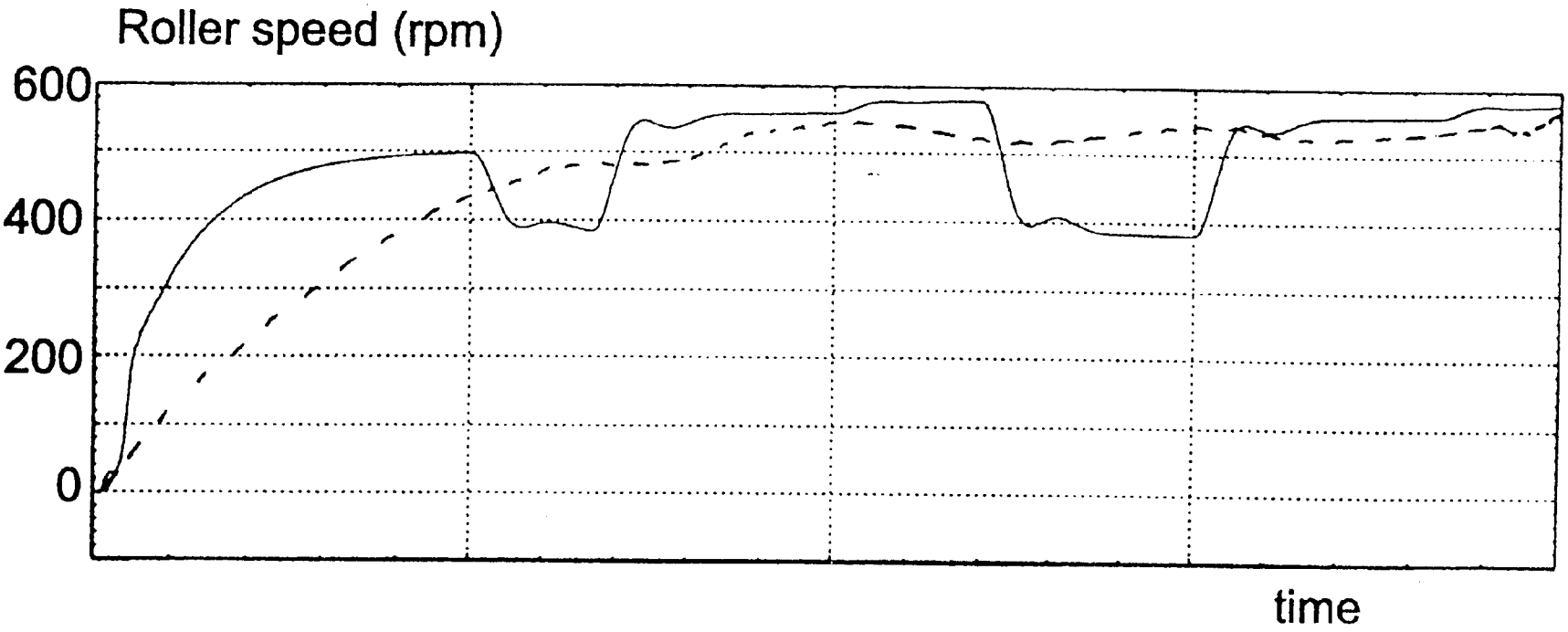
FIG. 3 is a graph of the control response characteristics of the controller in FIG. 2 compared with those of a prior art controller.

The actual speed of the roller 16 when controlled by the high-bandwidth controller of the present invention described above is shown as a function of time by means of the continuous line in FIG. 3. The output of a prior art controller which employs a flywheel is also shown, using the broken line in FIG. 3. The maximum variation in the speed of the roller when controlled by the prior art controller is about 50 revolutions per minute (rpm) at a mean speed of 550 rpm. The maximum variation with the high-bandwidth controller of FIG. 2, however, is about 180 rpm for the same mean belt speed.

In the controller of FIG. 2, the lack of a flywheel means that a high quality (low noise, low ripple) rotor position/speed sensor is desirable, typically an encoder which is substantially more expensive than the low quality RPT of the prior art controller with flywheel. However, small imperfections in the timing between sensor pulses and electrical noise are amplified twice in an RPT (and, to a lesser extent, an encoder). Firstly, they are amplified through converting rotor position to speed, which requires differentiation of the angle of the rotor with respect to time. Secondly, they are amplified through the high bandwidth controller itself. To put this in context, a 10% corruption on the position sensor signal in the controller of FIG. 2 would render the fluctuations in the belt speed so substantial as to make a treadmill constructed with such a position sensor and no flywheel unusable.

Alternative approaches to the control of the motor in the treadmill are illustrated in FIGS. 4–8. Here, the disturbance (i.e., the increased load on the motor generated when the foot impacts on the belt) is accommodated, and in a preferred embodiment substantially absorbed, using a controller which employs a composite state observer. The observer estimates the speed and/or load disturbance, and uses these estimates to control the system. The observable states and disturbances are estimated from any measurement and control inputs. The theory of the composite state observer is set out, for example, in 'Theory of Disturbance—Accommodating Controllers' by C. D. Johnson, in Chapter 7 of the book 'Advances in Control and Dynamic Systems', Vol.12, edited by C. T. Leondes, Academic Press, 1976, which is incorporated herein by reference.

The basic principles of observer theory will now be explained with reference to FIGS. 4 to 6. It has been found, in practice, that the disturbance—that is, the variation in the torque required from the motor to maintain the belt at a substantially constant speed as the foot strikes the belt—has a distinguishable pattern or waveform structure similar to the one illustrated in FIG. 5. It is this quasi-random combination of steps and ramps which facilitates the overall control of the system.

Generally, a waveform-structured disturbance w(t) can be expressed as a semideterministic analytical equation of the form:

$$w(t)=W(f_1(t),f_2(t), \ldots , f_m(t);c_1, \ldots ,c_L) \quad (1)$$

where $f_i(t)$, i=1,2, . . . M, are known functions and $C_K$, k=1,2, . . . L are unknown parameters which may occasionally jump in value in a random manner.

Embodiments of the present invention have been found to work well by using the limiting linear form of Equation (1) above:

$$w(t)=c_1f_1(t)+c_2f_2(t)+ \ldots +c_mf_m(t) \quad (2)$$

That is, the disturbance can be expressed as some weighted linear combination of known basis functions $f_i(t)$, with unknown weighting coefficients $c_i$, which jump in value in a random manner from time to time.

Figure 5:
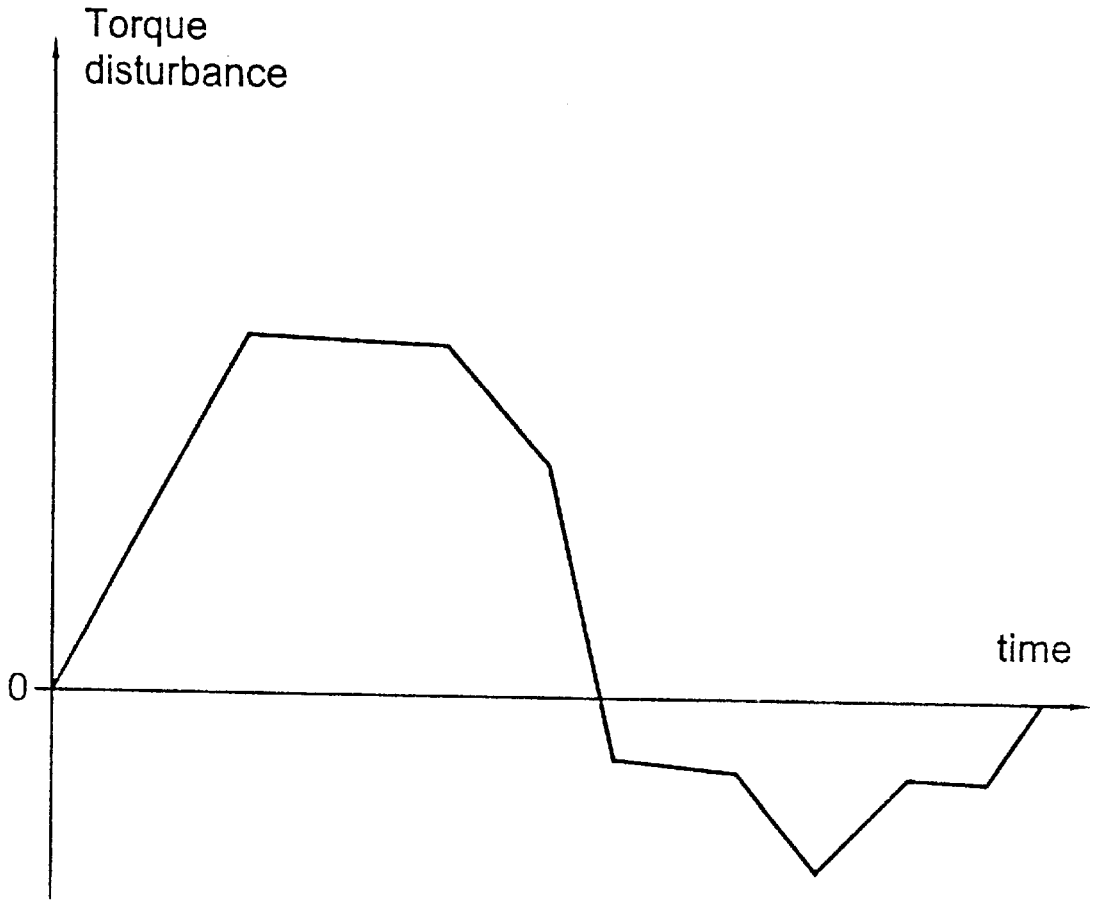
Fig 5 PRIOR ART
FIG. 5 is a graph of the variation in the required motor torque with time for a typical treadmill.

In the case of disturbance to be dealt with in the present case, shown in FIG. 5, the disturbance w(t) may be expressed as:

$$w(t)=c_1+c_2t \tag{3}$$

with weighting coefficients $c_1$ and $c_2$ that change in value in a random manner. It will be understood, in view of these constraints on $c_1$ and $c_2$ that Equation 3 is therefore only semi-quantitative.

In order to design a controller based on this theory, it is next desirable to derive a state model—that is, a differential equation satisfied by Equation (2) almost everywhere. This is typically difficult as there are often many equally 'correct' differential equations which are satisfied by this general expression. Realistic control system disturbances of the type shown in FIG. 5 are, however, usually Laplace transformable. It may then be shown that the disturbance w(t) described by the general expression of Equation 2 satisfies the linear time-invariant homogenous differential equation:

$$\frac{d^p w}{dt^p}+q_p\frac{d^{p-1}w}{dt^{p-1}}+q_{p-1}\frac{d^{p-2}w}{dt^{p-2}}+\ldots+q_2\frac{dw}{dt}+q_1w=0 \tag{4}$$

where $q_i$ (i=1,2, . . . ρ) are known as they are independent of $c_i$ and depend only on the set of known functions $f_i(t)$.

In order to account mathematically for the fact the $c_i$ may jump randomly, an external forcing function w(t), which consists of a series of completely unknown, randomly arriving, random intensity impulsive functions, is added to Equation 4. This is preferably a Dirac delta function. Thus, finally:

$$\frac{d^p w}{dt^p}+q_p\frac{d^{p-1}w}{dt^{p-1}}+q_{p-1}\frac{d^{p-2}w}{dt^{p-2}}+\ldots+q_2\frac{dw}{dt}+q_1w=w(t) \tag{5}$$

This single ρ th order differential equation is more usefully written as a set of first order differential equations in the canonical form which will be familiar to those skilled in the art:

$$w=z_1, \tag{6}$$

$$\dot{z}_1=z_2+\sigma_1(t),$$

$$\dot{z}_2=z_3+\sigma_2(t),$$

$$\dot{z}_{p-1}=z_p+\sigma_{p-1}(t),$$

$$\dot{z}_p-q_1-z_1-q_2z_2-\ldots-q_\rho z_\rho+\sigma_\rho(t) \tag{7}$$

where the overdot indicates the first differential with respect to t and the Dirac delta function w(t) of Equation 5 has been represented equivalently in Equations 6 and 7 in terms of a series of delta functions $\sigma_i(t)$ where i=1,2, . . . , ρ.

Generally, z(t) is a ρ-dimensional vector describing the 'state' of the disturbance w(t). It is analogous to the actual state x of a dynamical system where x is related to certain physical properties of the system. The value of the instantaneous state z(t) of an uncertain disturbance w(t) embodies all the information required to control a system even if future disturbances are unpredictable.

Turning now to the specific disturbance experienced in embodiments of the present invention and shown in FIG. 5, it was shown in Equation 3 that w(t) may be expressed in the form $w(t)=c_1$ and $c_2t$, from which by inspection w(t) satisfies the second order equation:

$$\frac{d^2 w}{dt^2}=w(t) \tag{8}$$

where w(t) is the unknown Dirac delta function. Rewriting this in the first order canonical form of Equations 6 and 7 gives:

$$w(t)=(1,0)\begin{pmatrix}z_1\\z_2\end{pmatrix} \tag{9}$$

and $$\dot{z}_1=z_2+\sigma_1(t),\ \dot{z}_2=0+\sigma_2(t) \tag{10}$$

The above theory forms the basis of a second embodiment of a controller for a treadmill or the like that is able to operate without a flywheel by absorbing the disturbances. The controller utilizes the fact that the system control inputs u(t) are linked to the current state x(t) of the system and the current state z(t) of the disturbance w(t).

$$u(t)=\phi(x(t),z(t),t) \tag{11}$$

It is usually not possible to measure the states x(t) and z(t) directly. On the other hand, it is possible to measure the current system outputs y(t) together with certain set points (or 'poles') in the system determining the rate, for example, at which the system returns to equilibrium during the absorption of a disturbance.

Provided the uncertain disturbances w(t) have a waveform structure, and can be modelled by a linear state model of the form given in Equations 6 and 7, a so-called state observer can be employed to generate reliably accurate online, real-time estimates x(t) of the instantaneous system state. As will be described in connection with FIG. 6, a composite state observer that also estimates online, real-time estimates of the instantaneous disturbance state $\hat{z}$ (t) may be constructed. In other words, the system control inputs u(t), which are a function of x(t), z(t) and t, may be defined instead in terms of estimates:

$$u(t)=\phi(\hat{x}(t),\hat{z}(t),t) \tag{12}$$

The estimation errors $\epsilon_x=x(t)-\hat{x}$ (t) and $\epsilon_z=z(t)-\hat{z}$ (t) are forced to reach zero quickly with respect to the overall system settling times by setting the composite observer poles to values defined by the values of the matrices $K_{xy}$, where x and y are integers defining the matrix coordinates.

The basic observer technique according to embodiments of the invention will now be described in relation to FIG. 4. The state equations of a disturbed system are taken to have the general form:

$$\dot{x}=A(t)x+B(t)u+F(t)w(t) \tag{13}$$

$$y=C(t)x+E(t)u(t)+G(t)w(t) \tag{14}$$

where it is the input (here, the total torque command), y is the online measured value of the actual system output, w(t) is a correction factor arising from unmeasured disturbances, errors in the model and parameter drifts, and x is the system state vector. The matrices A, B, C, E, F and G are assumed to be known.

In equation (13), F(T)w(T) is usually considered to be a state 'driving' disturbance. In equation (14), E(t)u(t) is a direct feedthrough, whereas G(t)w(t) is usually considered to be a measurement disturbance.

The system state estimate $\hat{x}$ can be substituted into Equation 13 above:

$$\frac{d\hat{x}}{dt} = A\hat{x} + Bu + w(t) \tag{15}$$

Figure 4:
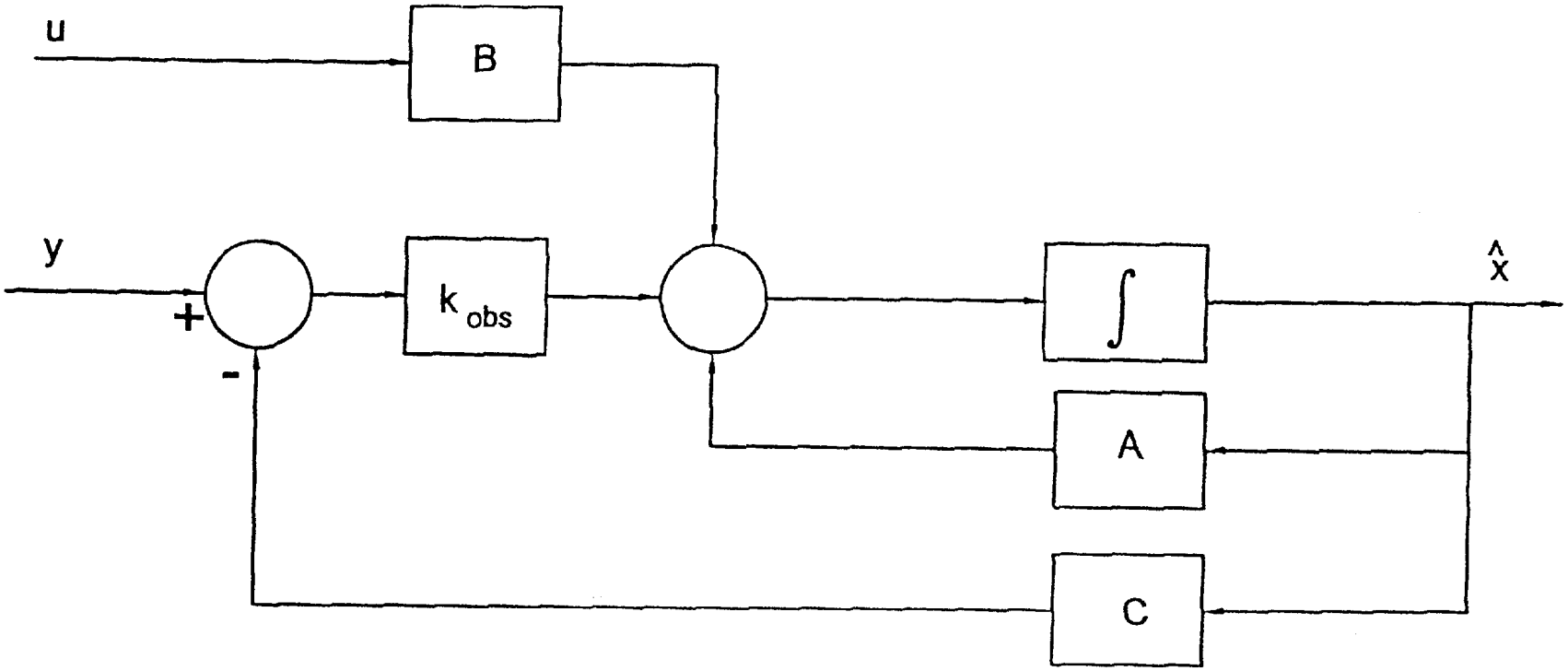
FIG. 4 is a flow diagram of an observer technique for second and third embodiments of a controller for use in the treadmill of FIG. 1.

FIG. 4 shows schematically the state estimate equation of Equation 15, in the particular case where the error is derived from the difference between the measured system output value and the state estimate:

$$\frac{d\hat{x}}{dt} = A\hat{x} + Bu + K_{obs}(y - C\hat{x}) \tag{16}$$

$K_{obs}$ is the settable system pole matrix (defining the observer gain) which is chosen to remove the error in the estimation within a timescale much shorter than the system settling time. $(y-C\hat{x})$ is an estimation error. This basic observer does not account for disturbances w(t).

Estimates of both the system state x(t) and the disturbance state z(t) may be obtained from the composite state observer expression given in the following Equation:

$$\begin{pmatrix} \dot{\hat{x}} \\ \dot{\hat{z}} \end{pmatrix} = \left[\begin{array}{c|c} A + K_{11}C & FH + K_{11}GH \\ \hline K_{21}C & D + [K_{21}]GH \end{array}\right]\begin{pmatrix} \hat{x} \\ \hat{z} \end{pmatrix} - \begin{pmatrix} K_{11} \\ K_{21} \end{pmatrix} y + \begin{pmatrix} B \\ 0 \end{pmatrix} u \tag{17}$$

where A, B, C, E, F, and G are the (assumed known) matrices of Equations 13 and 14 above, and D and H are the matrix operators of Equations 9 and 10—i.e. w(t)=H(t)z and $\dot{z}$=D(t)z+σ(t). As before, the values of $K_{xy}$ are selected to cause the system to approach equilibrium rapidly.

Figure 6:
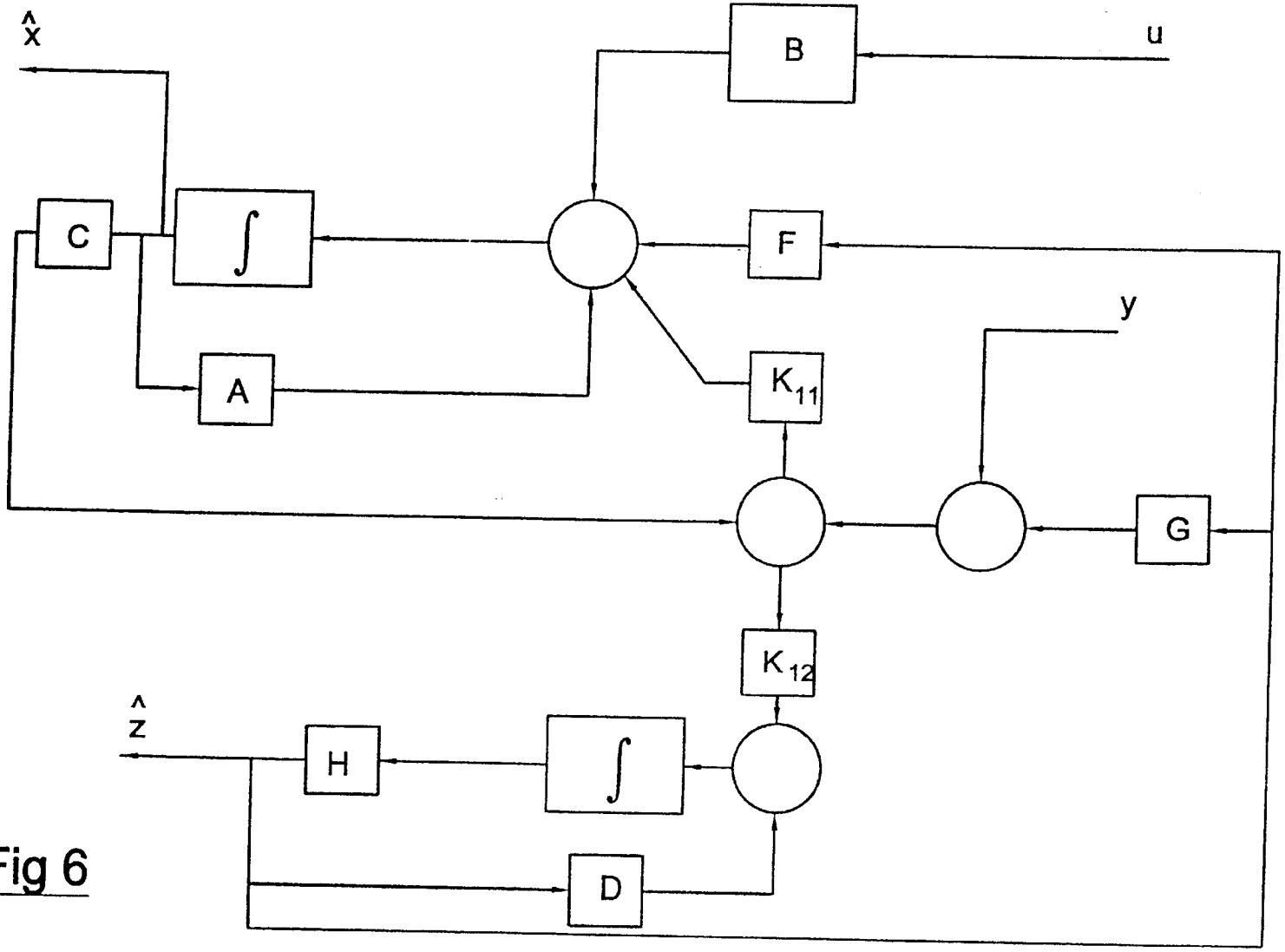
FIG. 6 is a flow diagram showing an alternative observer technique for the second and third embodiments of a controller according to the invention.

A flow chart illustrating the composite state observer equation (Equation 17) is illustrated schematically in FIG. 6.

Figure 7:
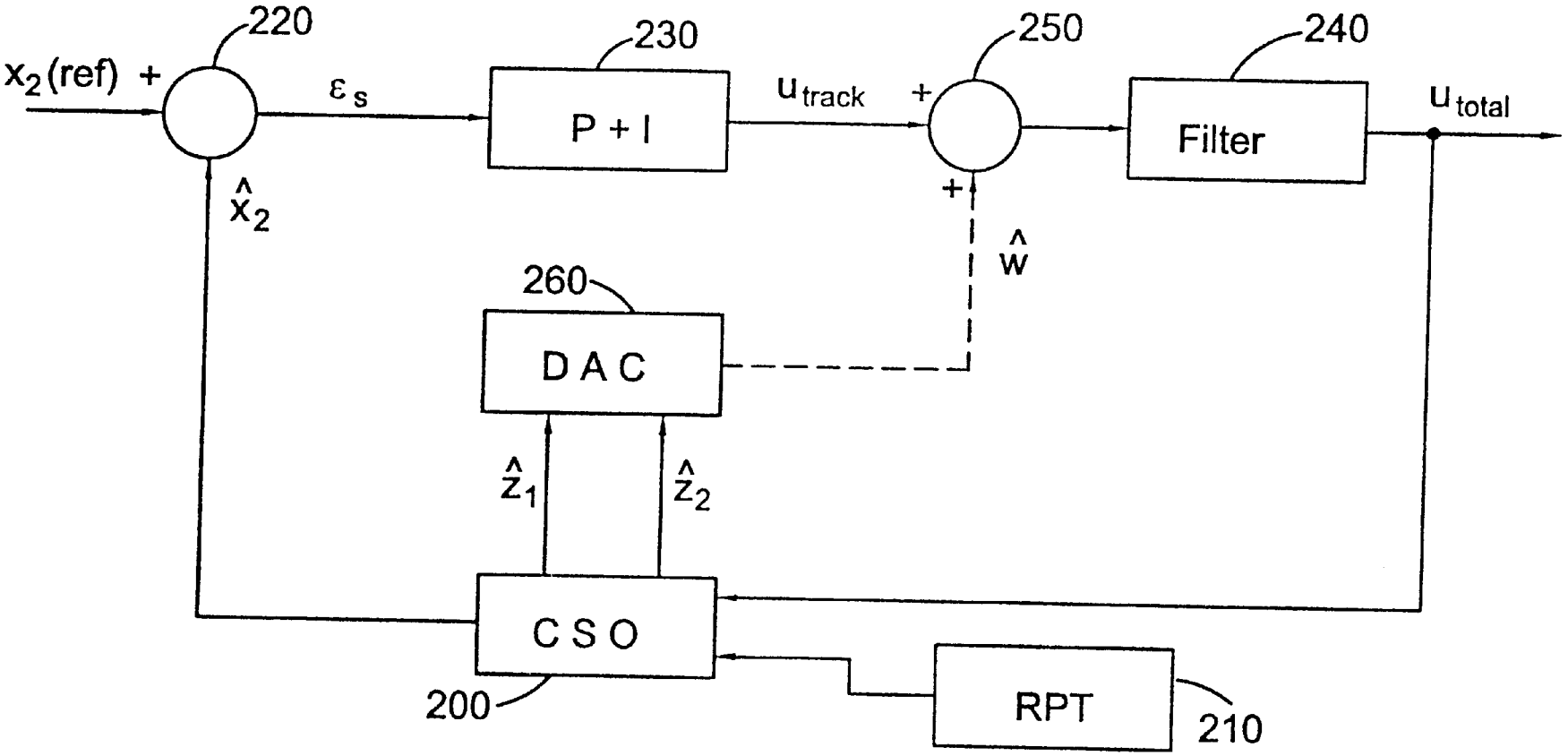
FIG. 7 is a schematic diagram of the second embodiment of the controller which employs the observer of FIGS. 4 and 6 for use in the treadmill of FIG. 1.

Turning now to FIG. 7, a block diagram of a motor controller according to an embodiment of the invention for the treadmill of FIG. 1 is shown. The controller incorporates the composite state observer of FIG. 6 and a proportional-plus-integral (P+I) controller.

In FIG. 7, a composite state observer 200 generates an estimate of the system state, $\hat{x}_2$, which is the speed of the rotor of the switched reluctance motor 26 used to drive the belt 20 in FIG. 1. The observer 200 also generates estimates of the load disturbance states, $\hat{z}_1$ and $\hat{z}_2$, caused by the runner's foot hitting the belt. The observer 200 has as inputs a signal from a rotor position transducer 210 and the control output $u_{total}$ (i.e. the torque demand) of the system which sets the torque required by the motor 26.

Figure 14A:
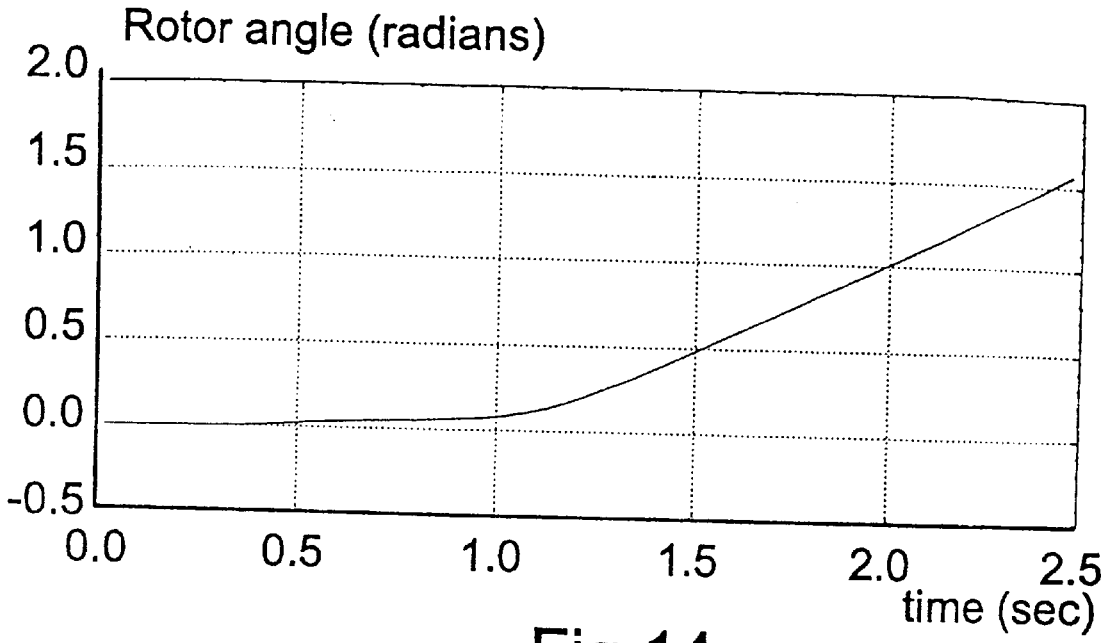
FIGS. 14*a* and 14*b* are plots of angle against time for the rotor in the motor of FIG. 1.
Figure 14B:
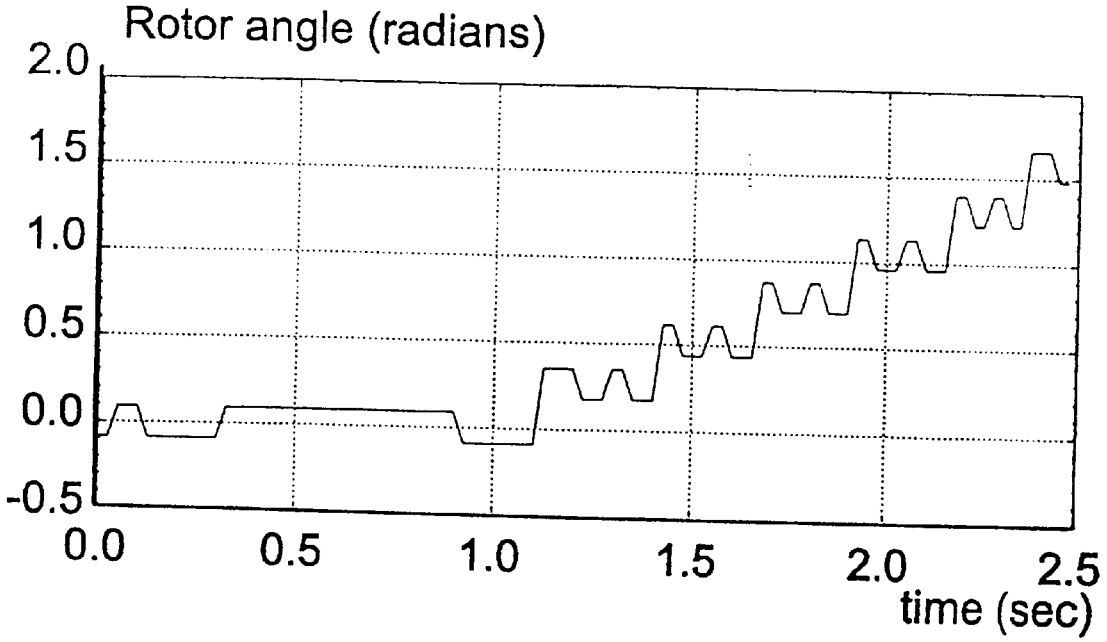

The RPT 210 has an output which contains inherent random noise from mechanical edge jitter and so forth, as well as systematic errors arising from mechanical quantization error and mechanical edge error due to output beam width, placement problems, etc. For example, in an RPT having 8 teeth with 2 edges each and 3 sensor heads, there will be 48 edges per mechanical cycle and 2π/48=π/24 rads (7.5°) quantization error and approximately 4° mechanical edge error. In order to minimize spikes in the RPT signal, a grey-scale method for decoding the rotor position may be employed. Other techniques which will be familiar to those skilled in the art may of course be used. The actual angle of the rotor is shown in FIG. 14*a*. The actual angle including the quantization and mechanical edge error from the RPT is shown in FIG. 14*b*, and it is this which is input to the observer 200.

In the embodiment of FIG. 7, only the speed estimate $\hat{x}_2$ is employed by the controller. This is subtracted at subtracter 220 from a speed reference $x_2$ (ref) which is set by the user of the treadmill and is representative of the desired speed of the belt. Of course, the angle estimate $\hat{x}_1$ could be employed instead or as well, and the implementation will be apparent to one skilled in the art.

The output of the subtracter 220 is a signal indicative of the estimated speed error ε which is received by a proportional-plus-integral (P+I) speed tracking controller 230. The controller 230 generates a torque demand $u_{track}$ which is the sum of the proportional error $K_p\,\epsilon_2$ and the integrated error $K_i\int\epsilon_2 dt$, $K_p$ and $K_i$ being multipliers. The P+I controller output $u_{track}$ is a signal representative of the total torque that would be necessary to operate the motor at the required speed in the absence of any disturbances.

The load disturbance state estimates $\hat{z}_1$ and $\hat{z}_2$ produced by the observer 200 act as inputs to a disturbance absorbing controller (DAC) 260. The output of the DAC is a disturbance absorbing torque command $\hat{w}$, which is a measure of the amount of torque adjustment necessary to cancel the effect of the load disturbance. Thus, the controller of FIG. 7 generates a motor speed or torque compensation signal based on the values of $u_{total}$ and the signal from the rotor position transducer 210. The disturbance absorbing torque command $\hat{w}$ and the tracking torque error $u_{track}$ are summed at adder 250 to generate the total torque signal $u_{total}$.

The total torque signal $u_{total}$ is finally filtered by the low pass filter 240 to improve the noise performance, i.e., to make the closed loop system robust to high frequency parasitic systems. The filtered output is fed to the controller 32 of FIG. 1. As already mentioned, this filtered total torque signal $u_{total}$ is additionally fed back to the observer 200.

FIG. 7 is shown employing a full state observer using the state estimate $\hat{x}_2$. However, it will be appreciated that a reduced state observer could be employed. Indeed, by removing the observer entirely (shown by the dotted line between the disturbance observing controller 260 and the adder 250), a controller similar to that shown in FIG. 2 is generated.

Figure 8:
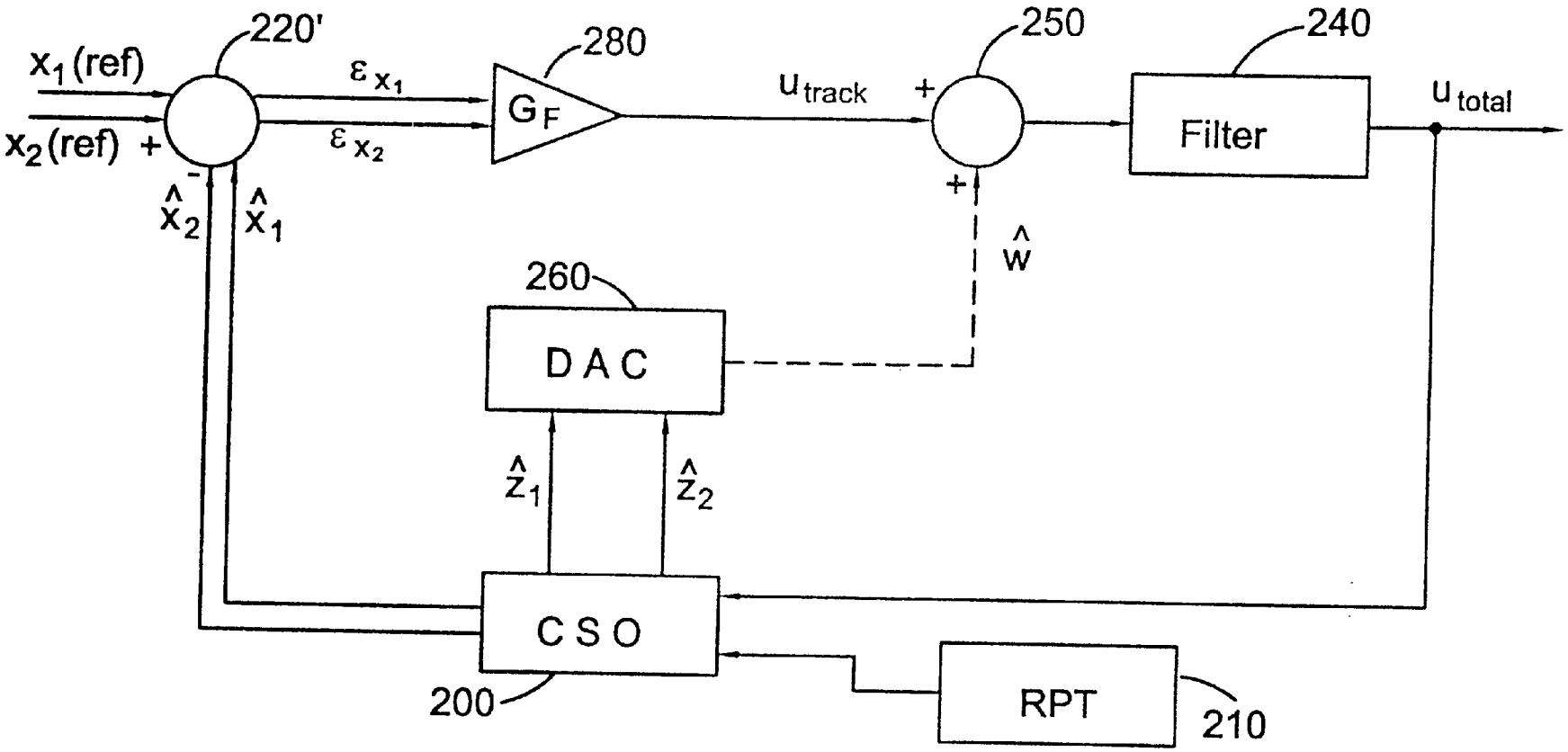
FIG. 8 is a schematic diagram of the third embodiment of the controller which employs the observer of FIGS. 4 or 6 for use in the treadmill of FIG. 1.

FIG. 8 shows a further embodiment of a motor controller. Components common to the embodiments of both FIG. 7 and FIG. 8 are labelled similarly.

As with FIG. 7, the composite state observer 200 has as inputs a signal from a rotor position transducer 210 and the output torque demand $u_{total}$ of the system which sets the torque required by the motor 26 of FIG. 1. In one form, the position and speed estimates $\hat{x}_1$, $\hat{x}_2$ are subtracted from their corresponding position and speed references $x_i$ (ref), $x_2$ (ref) at subtracter 220. The output of subtracter 200 is thus two signals $\epsilon_{x1}$, $\epsilon_{x2}$, which are combined by a (1×2) Gain matrix $G_F$ to produce the tracking torque demand $u_{track}$. That is, $$u_{track} = G_F\begin{bmatrix} K_1 \\ K_2 \end{bmatrix}[\{x_1(ref) - \hat{x}_1\} + \{x_2(ref) - \hat{x}_2\}] \tag{18}$$

where $$\begin{bmatrix} K_1 \\ K_2 \end{bmatrix}$$

is the Gain matrix $G_F$. The tracking torque demand $u_{track}$ is representative of the required torque in the absence of any disturbances. The tracking torque demand $u_{track}$ is combined at adder 250 with the disturbance estimate $\hat{w}$ which is produced by a disturbance accommodating controller 260. The summed output $u_{total}$ of the adder 250 is, as before, usually filtered by filter 240. The filtered output is indicative of the required torque from the motor 26.

As already described for FIG. 7, the disturbance accommodating controller can be omitted entirely, at the expense of system performance. Such an arrangement is indicated by the broken line in FIG. 8 between the disturbance accommodating controller 260 and the adder 250.

Figure 9:
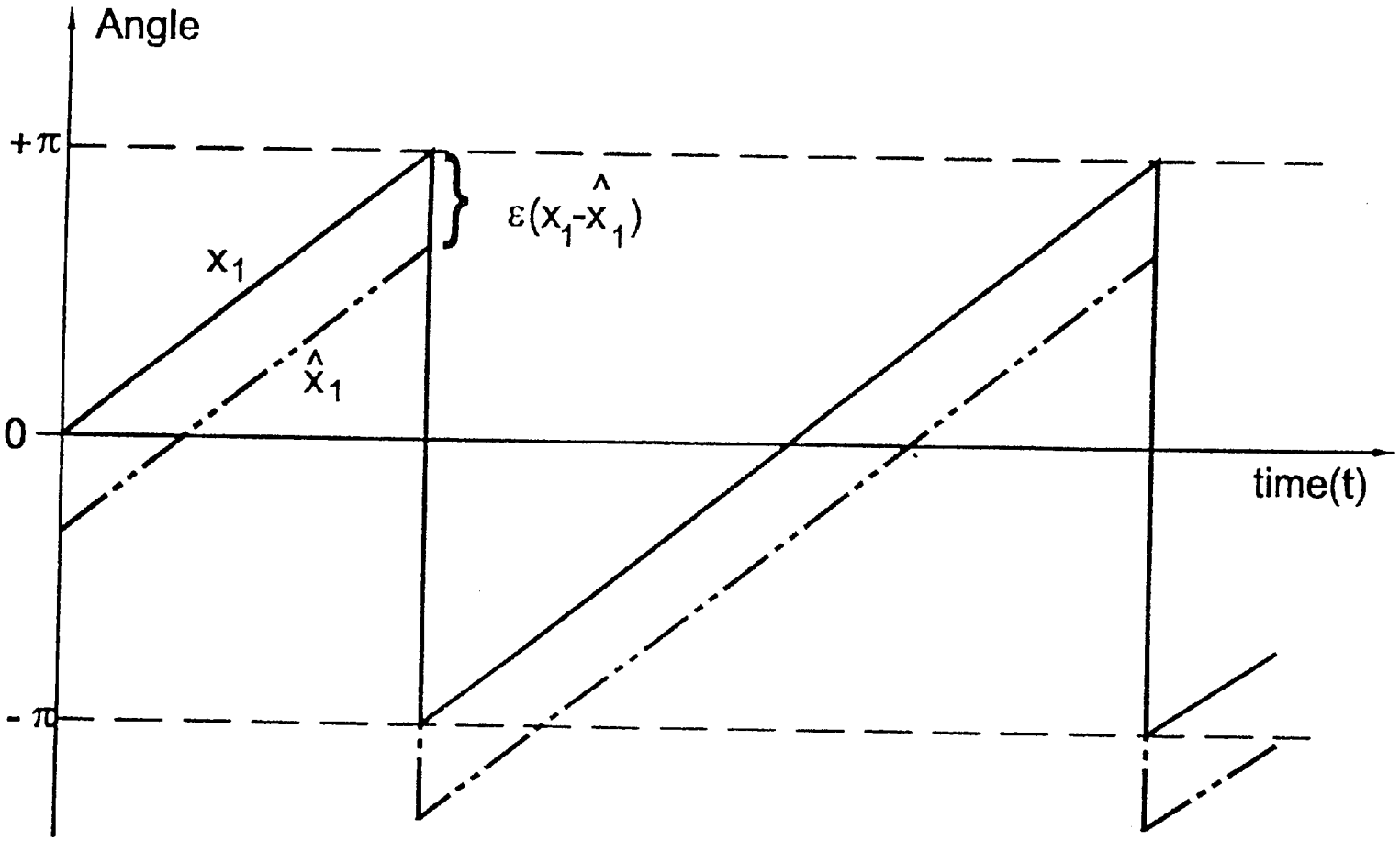
FIG. 9 is a schematic diagram of the angle reference pattern used to generate an input to the controller of FIG. 8.

The angle and speed references $x_1$ and $x_2$ for the controller of FIG. 8 are typically as shown in FIG. 9. The angle reference $x_1$ increases linearly with time, and the slope of the angle reference with respect to time provides the angular velocity (speed) reference $x_2$. The angle reference is in the form of a sawtooth Modulo $2\pi$ so that the angle does not integrate to infinity.

FIG. 9 also indicates the angle estimate $\hat{x}_1$ which will in practice follow the angle reference $x_1$ but with an error between the reference angle and the estimated angle.

FIGS. 10 to 13 show plots of the inputs and outputs of the control circuits of FIGS. 7 and 8.

FIGS. 10*a* to 10*h* show the signals generated at the various stages in the controller of FIG. 7, as a function of time. All of the components shown in FIG. 7 are connected (in particular, the disturbance accommodating controller 260 shown connected with a broken line).

Figure 10A:
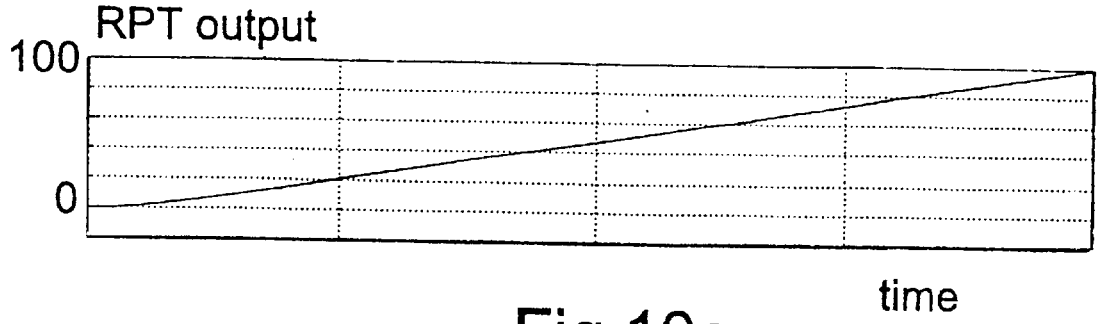
FIGS. 10*a* to 10*h* are plots of the signals generated at the various stages in the controller of FIG. 7, as a function of time.
Figure 10B:
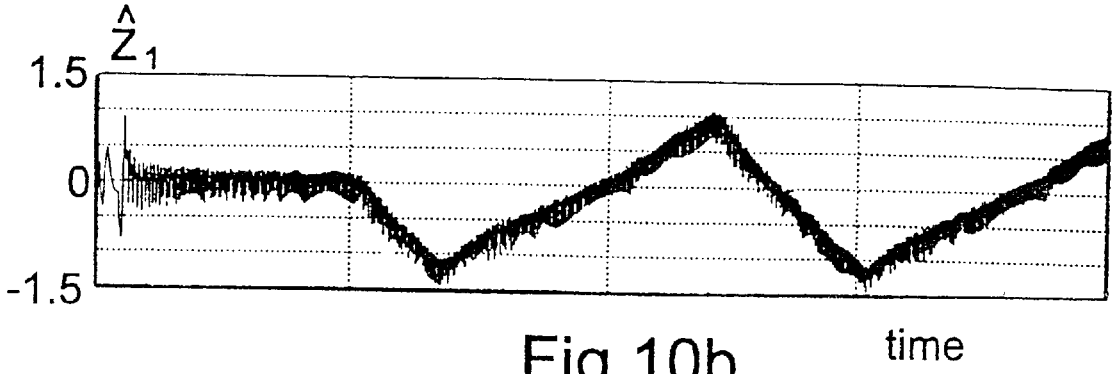
Figure 10C:
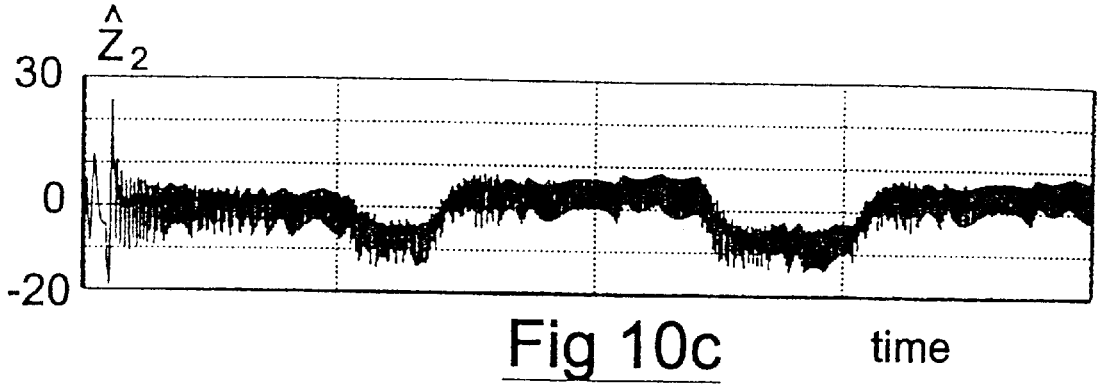
Figure 10D:
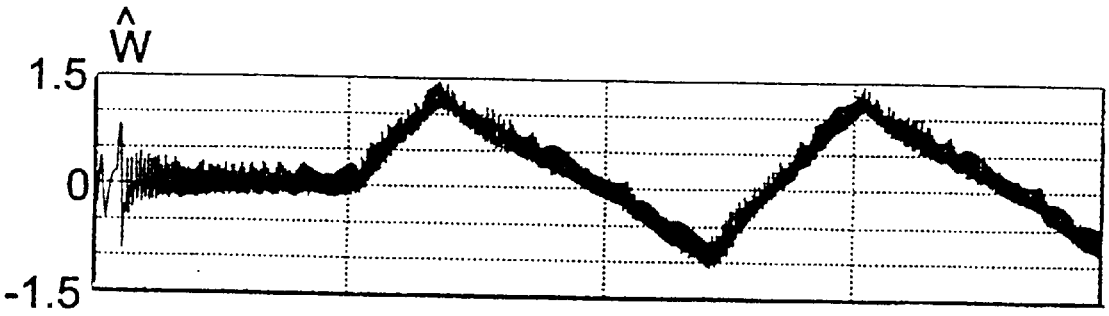
Figure 10E:
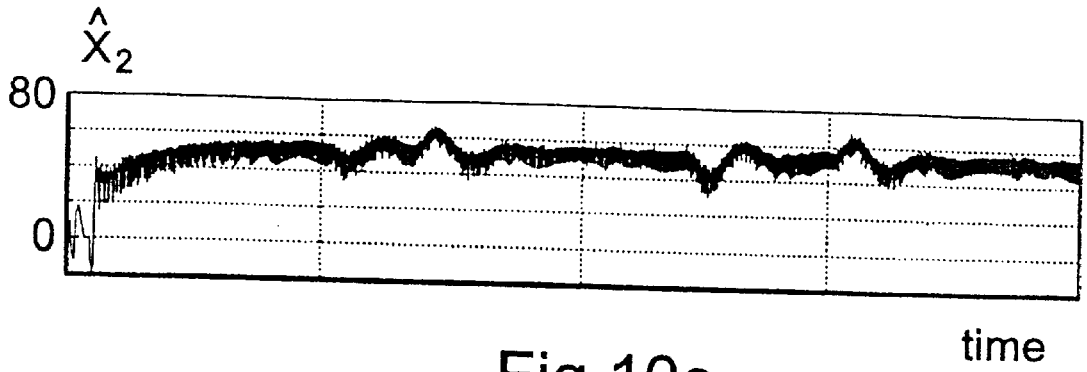

In FIG. 10*a*, the output of the RPT is shown. It should be noted that the output is of the form shown in FIG. 14*b*, i.e., it includes the quantization and other errors, even though these are not immediately visible in FIG. 10*a* because of the different scale. FIGS. 10*b* and 10*c* show the load disturbance state estimates $\hat{z}_1$ and $\hat{z}_2$ produced by the observer 200. FIG. 10*d* shows the output $\hat{w}$ of the disturbance accommodating controller 260, which multiplies the disturbance estimates by a 1×2 vector which is in this case (−1,0). FIG. 10*e* shows the estimated speed $\hat{x}_2$ generated by the composite state observer 200.

Figure 10F:
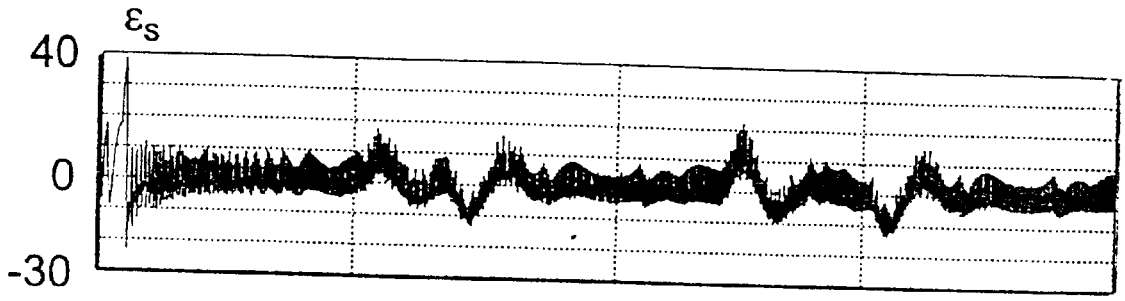
Figure 10G:
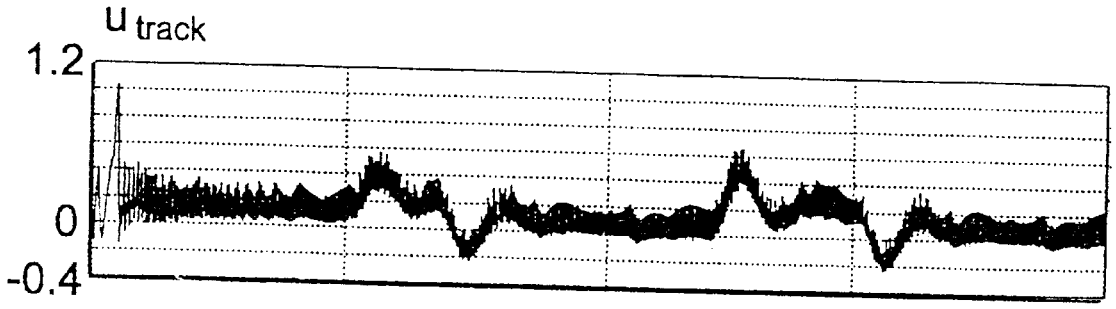
Figure 10H:
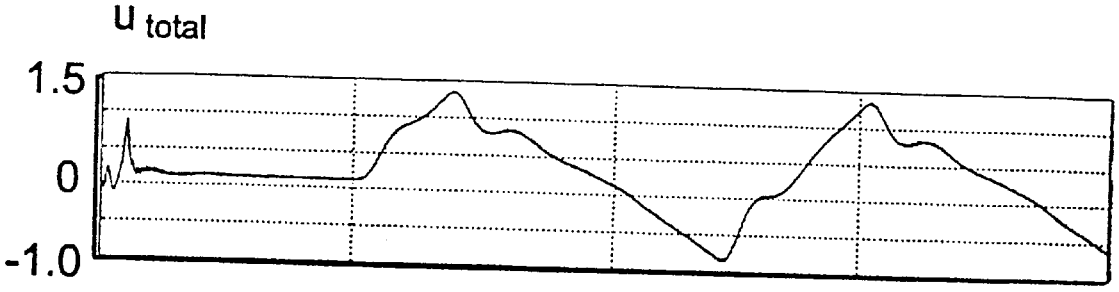

The speed error $\epsilon_s$ which is an output of the subtracter 220 is shown in FIG. 10*f*. The output $u_{track}$ of the P+I speed tracking controller 230 is shown in FIG. 10*g*, and the filtered sum of $u_{track}$ and $\hat{w}$, $u_{total}$, is shown in FIG. 10*h*.

FIGS. 11*a*to 11*f* show the signals generated at the various stages in the controller of FIG. 8, as a function of time. In this case, the composite state observer generates both position and speed estimates $\hat{x}_1$ and $\hat{x}_2$. However, the disturbance accommodating controller 260 is not connected to the adder 250.

Figure 11A:
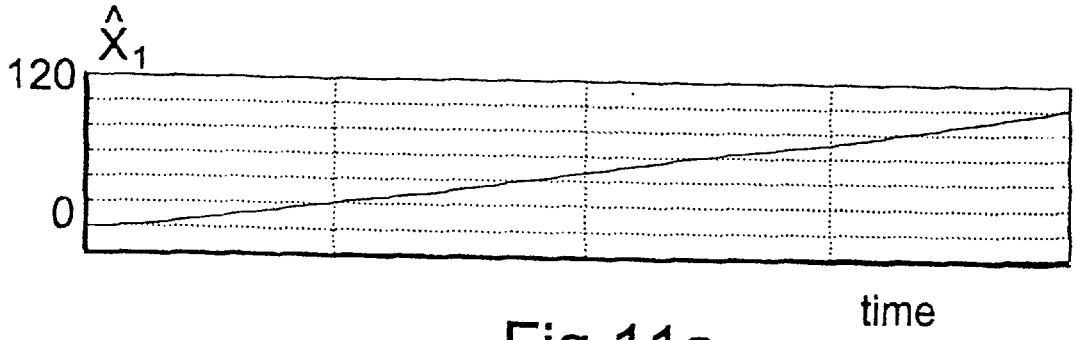
FIGS. 11*a* to 11*f* are plots of the signals generated at the various stages in the controller of FIG. 8, when arranged in a first manner, as a function of time.
Figure 11B:
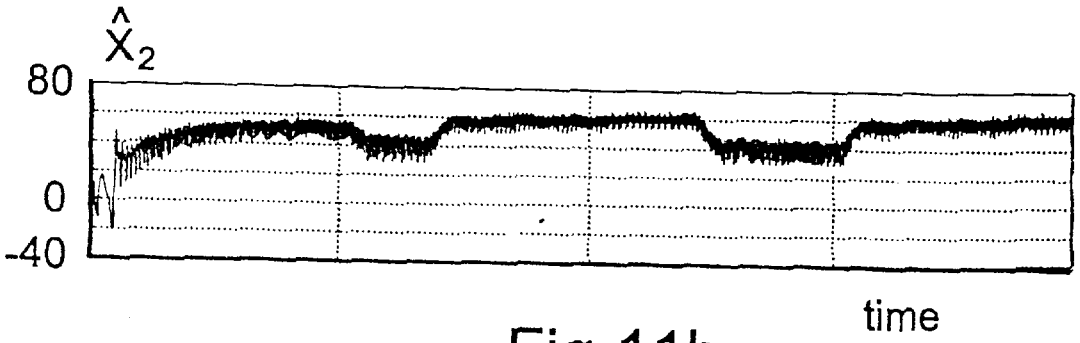
Figure 11C:
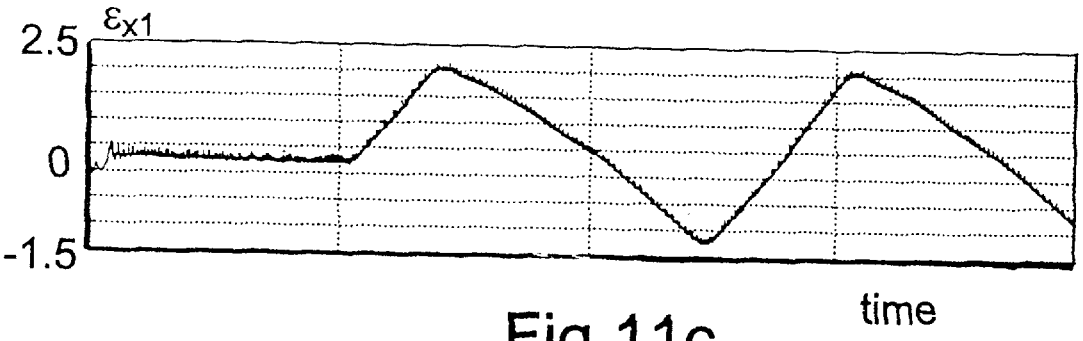
Figure 11D:
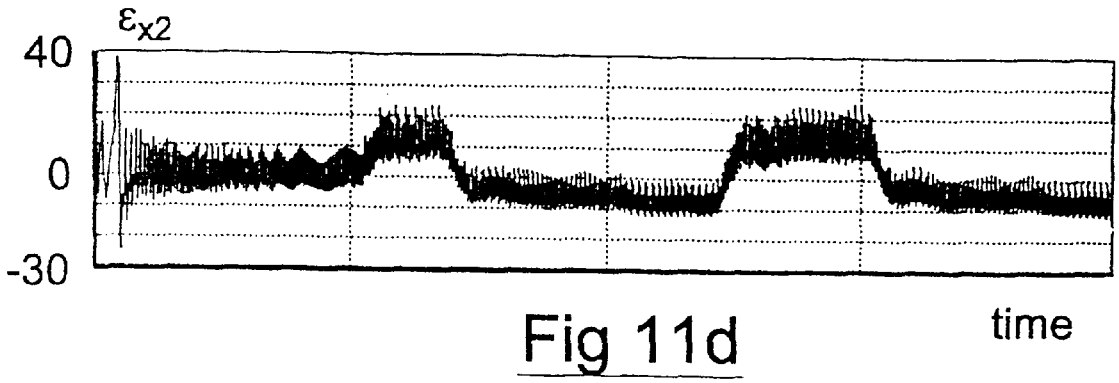
Figure 11E:
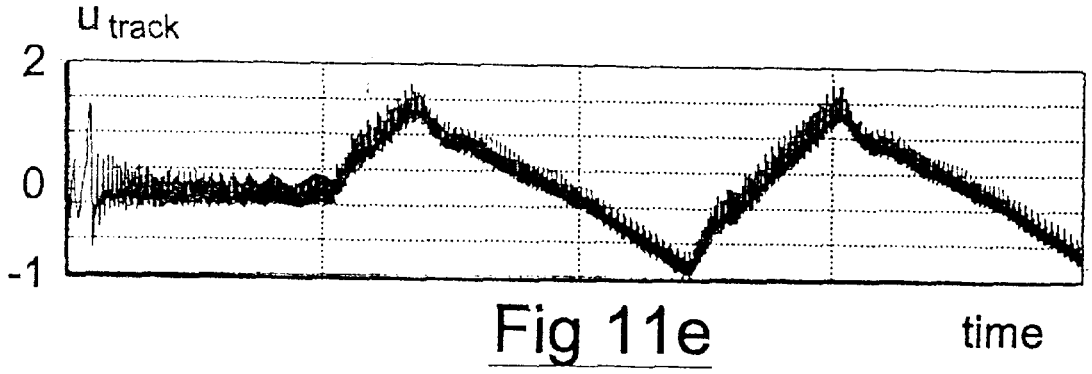

FIGS. 11*a* and 11*b* show the angle and speed estimates $\hat{x}_1$ and $\hat{x}_2$. FIGS. 11*c* and 11*d* show the position and speed error signals $\epsilon_{x1}$, $\epsilon\hat{x}_2$ which are combined by a (1×2) Gain matrix $G_F$ to produce the tracking torque demand $u_{track}$. $U_{track}$ is shown as a function of time in FIG. 11*e*.

Figure 11F:
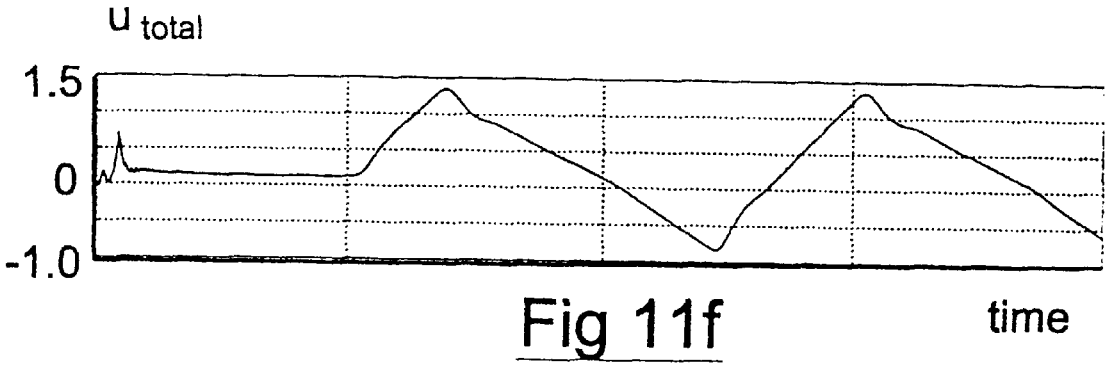

FIG. 11*f* shows $u_{total}$ once filtered. In this case, $u_{total}$= $u_{track}$ as the disturbance accommodating controller 260 is not connected.

FIGS. 12*a* to 12*g* show the signals generated at the various stages in the controller of FIG. 8, with the various connections exactly the same as described above in relation to FIGS. 11*a* to 11*f* except that the disturbance accommodating controller 260 is this time connected to the adder 250.

Figure 12A:
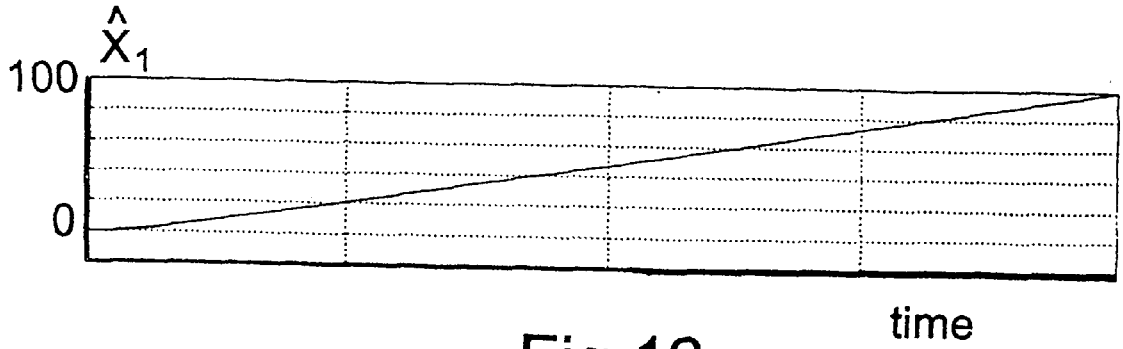
FIGS. 12*a* to 12*g* include plots of the signals generated at the various stages in the controller of FIG. 8, when arranged in a second manner, as a function of time.
Figure 12B:
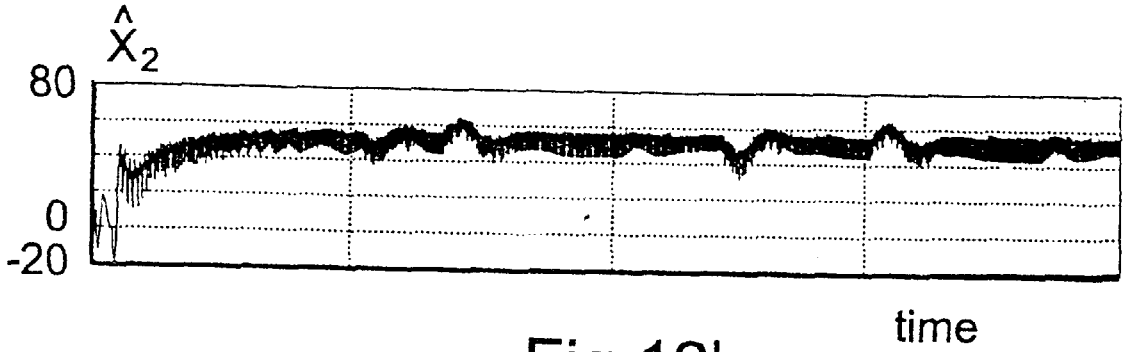
Figure 12C:
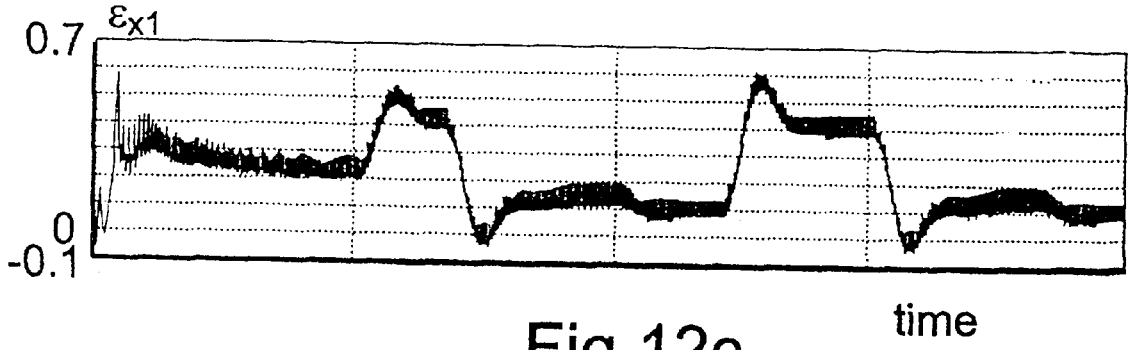
Figure 12D:
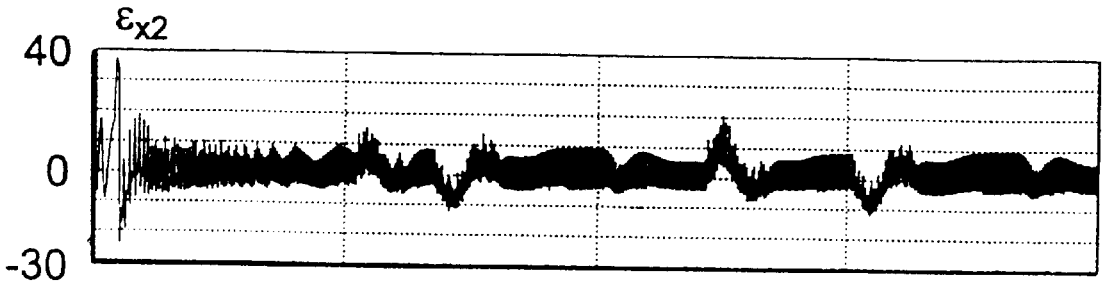
Figure 12E:
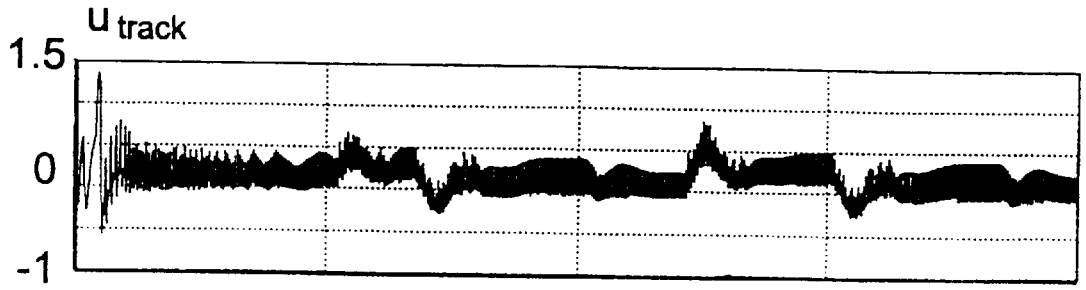
Figure 12F:
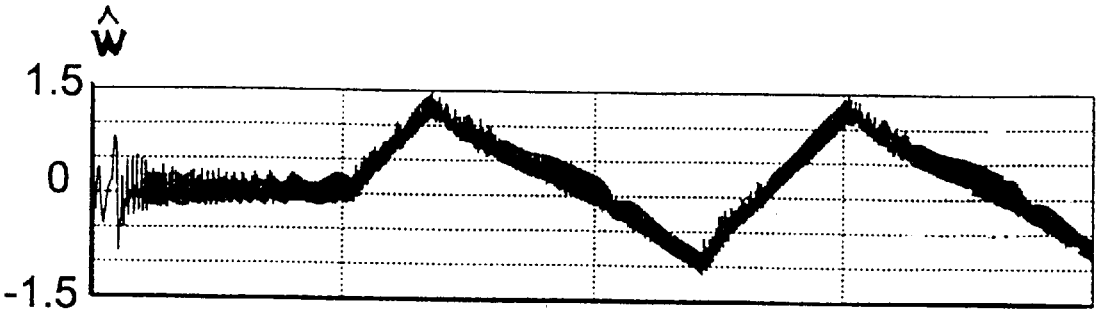
Figure 12G:
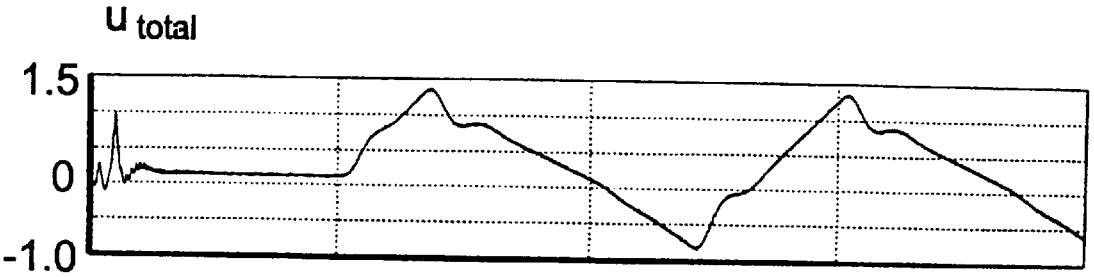

FIGS. 12*a* to 12*e* correspond to FIGS. 11*a* to 11*e*. FIG. 12*f* shows $\hat{w}$ as a function of time. Finally, FIG. 12*g* shows $u_{total}$ once filtered. $U_{total}$ is this time the sum of $u_{track}$ and $\hat{w}$.

Figure 13A:
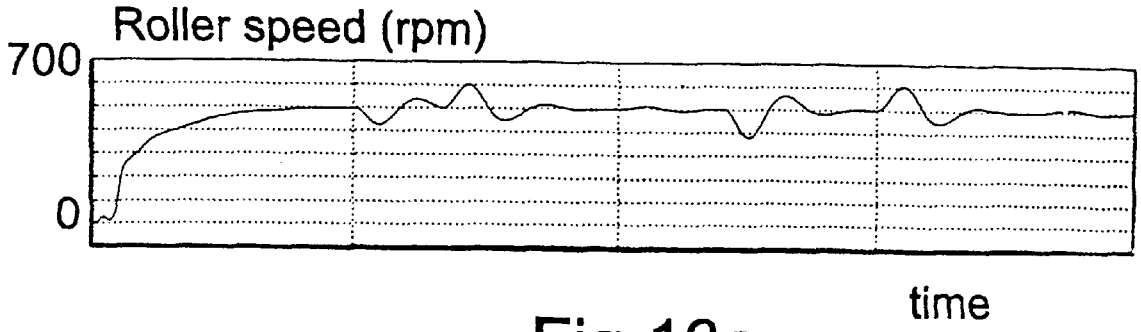
FIGS. 13*a* to 13*c* are plots of the roller speed of the treadmill of FIG. 1 as a function of time, when the belt is controlled by the controllers of FIGS. 7 and 8 respectively.

A plot of the roller speed of the treadmill of FIG. 1 as a function of time, when the belt is controlled by the controller of FIG. 7 and with the connections as described with reference to FIGS. 10*a*–10*h*, is shown in FIG. 13*a*.

Figure 13B:
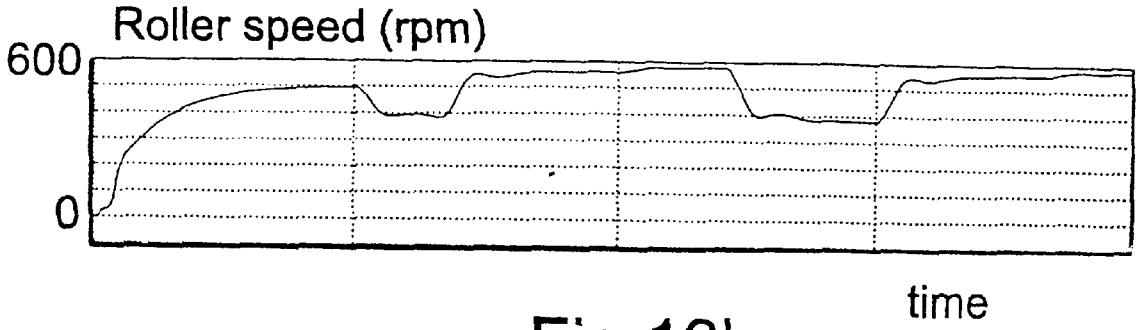

A similar plot of the belt speed of the treadmill of FIG. 1 as a function of time, this time with the belt controlled by the controller of FIG. 8 and with the connections as described with reference to FIGS. 11*a*–11*f*, is shown in FIG. 13*b*.

Figure 13C:
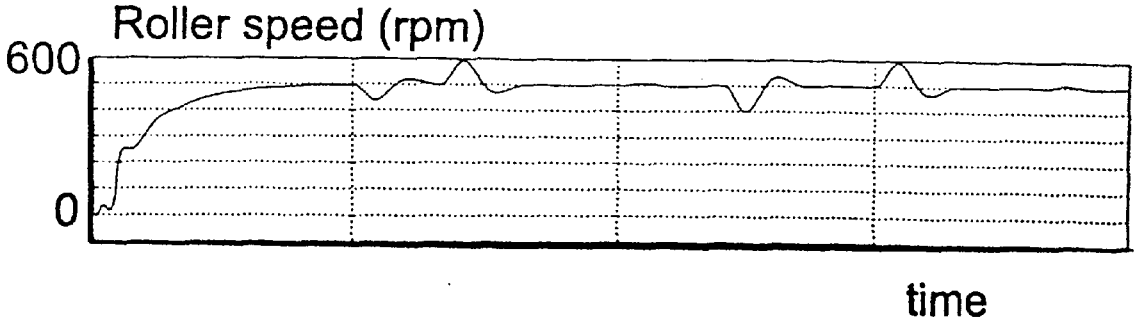

FIG. 13*c* shows the speed of the belt in FIG. 1 when controlled by the controller of FIG. 8 but with the connections as described with reference to FIGS. 12*a*–12*g*.

All plots are based on a 2 kW motor, rotating at a nominal 500 rpm, with a standard RPT. The composite state observer poles are set at −80, −100, −110 and −120. These values have been chosen to force the error in the estimates to tend to zero at a suitably rapid rate for a 2 kW motor.

The controllers described in connection with FIGS. 2, 7 and 8 are merely exemplary. The skilled reader will appreciate that other controllers which employ state observation could be used to control the motor, and indeed techniques other than the P+I solution described in connection with FIG. 2 are envisaged.

Clearly, the response of the controller will depend upon the number of components employed (i.e. the complexity of the observer). Nonetheless, the speed at which the system settles following a disturbance also depends upon the gain of the closed loop defining the control system. This is in turn governed largely by the quality of the output from the RPT. Of course, improving the quality of the RPT, or indeed replacing it with an encoder, introduces additional cost. It has been found in practice that, when the poles of the control loop are set as above, it is possible to employ a standard RPT while, as shown in FIG. 11, the system still typically settles within 30 ms. This is short enough that the user tends not to notice the variation in the belt speed. The overall belt speed control compares favorably with that of the prior art system including a flywheel, but with a reduction in cost, size and weight.

It will be appreciated that this invention is applicable to other exercise apparatus in which the prior art flywheel has been used to maintain the motor speed substantially constant in the presence of sudden changes in load. Embodiments of the invention apply, for example, to rowing machines, where the flywheel simulates the inertia of the oars and/or the boat and/or the water displaced by the oars, and to exercise cycles, where the flywheel simulates the inertia of the user and a bicycle.

Further, although the invention has been described in connection with a switched reluctance motor, other motors such as a brushless d.c. permanent magnet motor could be used. The switched reluctance motor has the advantages of relative cheapness and a very high torque to inertia ratio, which is particularly useful in the second embodiment of the present invention as it allows the control system designer to consider the motor as a torque source. Also, rotor position measurement is more easily achieved at low speeds in a switched reluctance motor than in a permanent magnet a.c. motor, provided sensorless rotor position detection is employed.

Accordingly, the principles of the invention, which have been disclosed by way of the above examples and discussion, can be implemented using various rotor arrangements. Those skilled in the art will readily recognize that these and various other modifications and changes can be made to the present invention without strictly following the exemplary applications illustrated and described herein and without departing from the spirit and scope of the present invention which are set forth in the following claims.

I claim:

1. Exercise apparatus comprising:

a switched reluctance machine;

a load operably connected with the machine;

user exercise means for varying the overall load on the machine when in use; and a controller for controlling an output of the machine, the controller including;

means for receiving a demand input, means for producing a control signal for adjusting the machine output in accordance with the demand input, state observer means for receiving a signal indicative of at least one machine parameter to produce a machine disturbance compensation signal, and means for applying the compensation signal to the control signal to assist the convergence of the machine output with the demand input.

2. Apparatus as claimed in claim 1 in which the switched reluctance machine comprises a rotor and a stator and the machine output is selected from the group comprising machine rotor position, speed, and torque.

3. Apparatus as claimed in claim 1 further comprising means for producing the signal indicative of at least one machine parameter, the at least one machine parameter being selected from the group comprising machine rotor position, speed, torque, current, and voltage.

4. Apparatus as claimed in claim 1 in which the machine comprises a rotor and a stator and the at least one machine parameter includes rotor position and machine speed, the apparatus further including means for producing a rotor position signal and means for producing a machine speed signal, the state observer means being arranged to produce the disturbance compensation signal in response to the rotor position signal and the machine speed signal.

5. Apparatus as claimed in claim 4 in which the means for producing the machine speed signal is arranged to produce a signal indicative of motor speed from the rotor position signal.

6. Apparatus as claimed in claim 4 in which the state observer means estimates machine speed and rotor position in dependence upon the control signal and the rotor position signal.

7. Apparatus as claimed in claim 6 in which the compensation signal is produced from an estimate of the load change on the user exercise means.

8. Exercise apparatus as claimed in claim 7 in which the rotor position and machine speed estimates and the load change estimate are related to the control signal and the rotor position signal by the equation:

$$\begin{pmatrix} \dot{\hat{x}} \\ \dot{\hat{z}} \end{pmatrix} = \left[\begin{array}{c|c} A + K_{11}C & FH + K_{11}GH \\ \hline K_{21}C & D + [K_{21}]GH \end{array}\right] \begin{pmatrix} \hat{x} \\ \hat{z} \end{pmatrix} - \begin{pmatrix} K_{11} \\ K_{21} \end{pmatrix} y + \begin{pmatrix} B \\ 0 \end{pmatrix} u$$

where A, B, C, D, E, F, G, H, $K_{11}$ and $K_{21}$ are known matrices and/or vectors associates with the apparatus, u is the control signal, y is the rotor position signal from the rotor position signal producing means, $\hat{x}_1$ is the rotor position estimate, $\hat{x}_2$ is the machine speed estimate, and $\hat{z}_1$ and $\hat{z}_2$ are the load change estimates.

9. Exercise apparatus as claimed in claim 1, in which the exercise apparatus is a treadmill, the load including a roller and the user exercise means comprising a conveyor engaged by the roller providing a rolling road surface.

10. Apparatus as claimed in claim 1 in which the exercise apparatus is selected from the group consisting of a rowing machine and an exercise cycle.

11. Apparatus as claimed in claim 1, including a comparator for comparing a speed estimate output from the state observer means with a speed reference signal, as the demand input, to produce an error signal; and an adder for adding the compensation signal to the error signal to assist in the convergence of the machine output with the demand input.

12. Exercise apparatus comprising:

a switched reluctance machine;

a load operably connected with the machine;

a user exercise device constructed and arranged to vary the overall load on the machine when in use; and a controller for controlling an output of the machine, the controller receiving a demand input and producing a control signal for adjusting the machine output in accordance with the demand input, the controller including a state observer constructed and arranged to receive a signal indicative of at least one machine parameter to produce a machine disturbance compensation signal;

wherein the controller applies the compensation signal to the control signal to assist the convergence of the machine output with the demand input.

13. Apparatus as claimed in claim 12 in which the switched reluctance machine comprises a rotor and a stator and the machine output is selected from the group comprising machine rotor position, speed, and torque.

14. Apparatus as claimed in claim 12 in which the machine comprises a rotor and a stator and the at least one machine parameter includes rotor position and machine speed, the apparatus producing a rotor position signal and a machine speed signal, the state observer being constructed and arranged to produce the disturbance compensation signal in response to the rotor position signal and the machine speed signal.

15. Apparatus as claimed in claim 14 in which the state observer estimates machine speed and rotor position in dependence upon the control signal and the rotor position signal.

16. Apparatus as claimed in claim 15 in which the compensation signal is produced from an estimate of the load change on the user exercise device.

17. Apparatus as claimed in claim 12, in which the apparatus is a treadmill, the load including a roller and the user exercise device comprising a conveyor engaged by the roller providing a rolling road surface.

18. A method of controlling an exercise apparatus, the exercise apparatus comprising a switched reluctance machine, a load operably connected with the machine, a user exercise device constructed and arranged to vary the overall load on the machine when in use, and a controller for controlling an output of the machine, the method comprising:

receiving a demand input with the controller;

producing a control signal for adjusting machine output in accordance with the demand input;

receiving a signal indicative of at least one machine parameter with a state observer to produce a machine disturbance compensation signal; and applying the compensation signal to the control signal to assist convergence of the machine output with the demand input.

19. The method as claimed in claim 18 in which the machine comprises a rotor and a stator and the at least one machine parameter includes rotor position and machine speed, the method further including:

producing a rotor position signal;

producing a machine speed signal; and arranging the state observer to produce the disturbance compensation signal in response to the rotor position signal and the machine speed signal.

* * * * *

UNITED STATES PATENT AND TRADEMARK OFFICE

CERTIFICATE OF CORRECTION

PATENT NO. : 6,066,074
DATED : May 23, 2000
INVENTOR(S) : Marcinkiewicz

It is certified that error appears in the above-identified patent and that said Letters Patent is hereby corrected as shown below:

Title page,
Section entitled "References Cited U.S. PATENT DOCUMENTS", insert --
U.S. 5,256,115 10/1993 Scholder et al.....482/6 --;
In an additional section entitled "References Cited OTHER DOCUMENTS", insert -- Johnson, C.D., "Algebraic Solution of the Servomechanism Problem with External Disturbances", Journal of Dynamic Systems, Measurement, and Control, March 1974, pp. 25-35 -- and -- Johnson, C.D., "Theory of Disturbance-Accommodating Controllers" chapter 7 of Advances in Control and Dynamic Systems, Vol. 12, (C.T. Leondes, ed.), 1976, pp. 387-489 --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*